US008428268B2

(12) United States Patent
Konagai et al.

(10) Patent No.: US 8,428,268 B2
(45) Date of Patent: Apr. 23, 2013

(54) ARRAY SPEAKER APPARATUS

(75) Inventors: Yusuke Konagai, Hamamatsu (JP); Kenichiro Takeshita, Hamamatsu (JP); Susumu Takumai, Hamamatsu (JP)

(73) Assignee: Yamaha Corporation (JP)

( * ) Notice: Subject to any disclaimer, the term of this patent is extended or adjusted under 35 U.S.C. 154(b) by 1257 days.

(21) Appl. No.: 12/045,668

(22) Filed: Mar. 10, 2008

(65) Prior Publication Data

US 2008/0226084 A1 Sep. 18, 2008

(30) Foreign Application Priority Data

Mar. 12, 2007 (JP) ..... 2007-061574

(51) Int. Cl.
*H04R 5/00* (2006.01)

(52) U.S. Cl.
USPC ..... 381/17

(58) Field of Classification Search ..... 381/17
See application file for complete search history.

(56) References Cited

U.S. PATENT DOCUMENTS

| | | | | |
|---|---|---|---|---|
| 5,440,639 | A | 8/1995 | Suzuki et al. | |
| 5,666,425 | A * | 9/1997 | Sibbald et al. | 381/26 |
| 5,761,315 | A | 6/1998 | Iida et al. | |
| 5,870,484 | A | 2/1999 | Greenberger | |
| 5,999,630 | A | 12/1999 | Iwamatsu | |
| 7,130,430 | B2 | 10/2006 | Milsap | |
| 7,545,946 | B2 | 6/2009 | Melanson | |
| 7,561,706 | B2 | 7/2009 | Holmi | |
| 7,577,260 | B1 | 8/2009 | Hooley | |
| 7,606,380 | B2 | 10/2009 | Melanson | |
| 7,929,709 | B2 | 4/2011 | Katayama | |
| 8,041,060 | B2 | 10/2011 | Takumai | |
| 8,223,992 | B2 | 7/2012 | Suzuki et al. | |

(Continued)

FOREIGN PATENT DOCUMENTS

| | | |
|---|---|---|
| EP | 0 637 191 A2 | 2/1995 |
| EP | 1760920 A1 | 3/2007 |

(Continued)

OTHER PUBLICATIONS

Notification of Reasons for Refusal issued on Apr. 21, 2009 in corresponding to Japanese Patent Application No. 2007-061575.

(Continued)

*Primary Examiner* — Fernando L Toledo
*Assistant Examiner* — Neil Prasad
(74) *Attorney, Agent, or Firm* — Rossi, Kimms & McDowell LLP

(57) ABSTRACT

An array speaker apparatus includes an array speaker in which plural speaker units are arranged in a single body, a sound source localization adding unit which generates left and right audio signals by performing localization processing for adding sound characteristics to audio signals of a front-left channel and a front-right channel on the basis of head transfer functions, and a sound emitting direction control unit which distributes the left and right audio signals to one or plural speaker units of the array speaker, and controls timing with which the speaker units output the audio signals so that a left sound emitted from the array speaker forms the same sound wavefront formed by a sound emitted from one of virtual point sound sources and that a right sound emitted from the array speaker forms the same sound wavefront formed by a sound emitted from the other of the virtual point sound sources.

7 Claims, 8 Drawing Sheets

U.S. PATENT DOCUMENTS

| | | | | |
|---|---|---|---|---|
| 2003/0026441 | A1* | 2/2003 | Faller | 381/98 |
| 2005/0117753 | A1 | 6/2005 | Miura et al. | |
| 2005/0117762 | A1 | 6/2005 | Sakurai et al. | |
| 2006/0045295 | A1* | 3/2006 | Kim | 381/310 |
| 2006/0126878 | A1 | 6/2006 | Takumai et al. | |
| 2006/0210101 | A1 | 9/2006 | Ishibashi et al. | |
| 2006/0269070 | A1 | 11/2006 | Miura et al. | |
| 2007/0030976 | A1 | 2/2007 | Konagai | |
| 2007/0217621 | A1 | 9/2007 | Takumai | |
| 2007/0230724 | A1 | 10/2007 | Konagai | |
| 2007/0286427 | A1 | 12/2007 | Jung | |
| 2008/0101631 | A1 | 5/2008 | Jung | |
| 2008/0165979 | A1 | 7/2008 | Takumai | |
| 2008/0226084 | A1 | 9/2008 | Konagai | |
| 2008/0273721 | A1 | 11/2008 | Walsh | |
| 2009/0010455 | A1 | 1/2009 | Suzuki | |
| 2009/0028358 | A1 | 1/2009 | Suzuki | |
| 2010/0189267 | A1 | 7/2010 | Konagai et al. | |

FOREIGN PATENT DOCUMENTS

| | | | |
|---|---|---|---|
| JP | 57-23691 | U | 2/1982 |
| JP | 05-260597 | A | 10/1993 |
| JP | 6-133399 | A | 5/1994 |
| JP | 06-205496 | | 7/1994 |
| JP | 8-51698 | A | 2/1996 |
| JP | 8-146974 | A | 6/1996 |
| JP | 9-46800 | A | 2/1997 |
| JP | 9-233599 | A | 9/1997 |
| JP | 2005-012765 | A | 1/2005 |
| JP | 2005-167612 | A | 6/2005 |
| JP | 2005-286828 | A | 10/2005 |
| JP | 2006-013711 | A | 1/2006 |
| JP | 2006-060610 | A | 3/2006 |
| JP | 2006-067218 | A | 3/2006 |
| JP | 2006-114945 | A | 4/2006 |
| JP | 2006-238155 | A | 9/2006 |
| JP | 2006-246310 | A | 9/2006 |
| JP | 2006-258442 | A | 9/2006 |
| JP | 2006-303658 | A | 11/2006 |
| JP | 2006-313980 | A | 11/2006 |
| JP | 2006-340302 | A | 12/2006 |
| JP | 2006-340306 | A | 12/2006 |
| JP | 2007-049413 | A | 2/2007 |
| JP | 2007-068000 | A | 3/2007 |
| JP | 2007-110744 | A | 4/2007 |
| JP | 2008-227803 | A | 9/2008 |
| WO | 2006/001272 | A1 | 1/2006 |

OTHER PUBLICATIONS

Notification of Reasons for Refusal issued in corresponding Japanese Patent Application No. 2007-061574 dated Jan. 6, 2009.

International Search Report issued on Oct. 22, 2009 in corresponding EP Patent Application No. 08004585.9. Full Translation.

Extended European Search for EP 1000889.5, dated Jun. 11, 2010. Cited in co-pending application US 2009-0010455.

Notification of Reasons for Refusal for JP 2007-175489, dated Jul. 23, 2009. Cited in co-pending application US 2009-0010455.

Notification of Reasons for Refusal for JP 2007-190835, dated Jul. 23, 2009. Cited in co-pending application US 2009-0010455.

* cited by examiner

ARRAY SPEAKER APPARATUS

BACKGROUND

The present invention relates to a surround array speaker apparatus which is high in the degree of freedom of selection of an installation place.

In recent years, array speaker apparatus capable of producing a surround sound field though they employ a single body (refer to Patent document 1, for example). The array speaker apparatus disclosed in Patent document 1 is a system capable of expressing a sound field expanse in the right-left and front-rear directions by means of only a single speaker that is disposed in front of a listener and hence is called a front surround system. Employing a single body as mentioned above, this array speaker apparatus does not require installation of plural speakers and related wiring and can thus be installed easily.

FIG. 1 shows the principle of an array speaker and a surround sound field as generated by an array speaker apparatus. The array speaker apparatus disclosed in Patent document 1 operates according to the principle of the delayed array. As shown in FIG. 1A, the same acoustic signal is input, with delays that are a little different from each other, to plural speaker units SPa-SPe that are arranged in line or in a plane so as to produce a sound field as would be produced when speaker units SPa'-SPe' emit sounds simultaneously. Resulting sounds simultaneously reach a single point F (focal point) in the space and the acoustic energy around the focal point F is intensified through in-phase addition. In this manner, sound beams having high directivity toward the focal point F can be generated. This technique is called the delayed array. In array speaker apparatus, audio signals for generating multichannel sound beams can be input to each speaker unit in superimposition because the system including the speaker units constituting the array speaker and the space to which sounds are emitted from the speaker units are generally a linear system. As shown in FIG. 1B, an array speaker apparatus 1 produces, around a listener H, a surround sound field corresponding to a moving picture being displayed on a monitor 3 by generating virtual sound sources by emitting plural (i.e., multichannel) sound beams simultaneously and causing them to be reflected by walls.

[Patent document 1] JP-A-2006-238155

To produce a surround sound field or generate localized virtual sound sources in directions that are different from the direction of the speaker by an array speaker, the following two conditions should necessarily be satisfied:

1) To produce a surround sound field or generate virtual sound sources in directions that are different from the direction of the speaker, the presence of walls that reflect sound beams and thereby localize virtual sound sources is indispensable.

2) To localize virtual sound sources on walls, sound beams that reach a listener after being reflected by the walls should be sufficiently stronger than a sound that reaches the listener directly from the speaker (inverse to the precedence effect). Furthermore, since the sound attenuates according to the ratio between distances, virtual sound sources cannot be localized if the lengths of sound beam paths are much different from the length of a direct sound path. Therefore, the ratios between the lengths of the reflection sound beam paths and the length of the direct sound path should be set in a certain range. Still further, in a near sound field, the interference between speaker units is remarkable and one can notice a variation between their frequency characteristics. Therefore, the listening position needs to be spaced from the speaker units to some extent. That is, it is indispensable to set a certain distance between the speaker and the listener.

However, a listener's room is not necessarily ideal: a speaker may be installed in such a manner as not to be suitable for generation of surround sounds by an array speaker (e.g., the distances between the listener and the left and right walls are much different from each other or the speaker is set obliquely at a corner of the room). If the speaker is installed in such a state (particularly in the case where wall reflection is used for the front-left and front-right channels), the audibility is lowered because of insufficient reflection or right/left-unbalanced reflection. There is another problem that if a direct sound is used, a sufficient sense of separation cannot be obtained because of the employment of the single body.

SUMMARY

An object of the present invention is therefore to provide a surround array speaker apparatus that is high in the degree of freedom of selection of an installation place.

The invention provides the following configurations.

(1) An array speaker apparatus, comprising:

an array speaker in which plural speaker units are arranged in a single body;

a sound source localization adding unit which generates left and right audio signals by performing localization processing for adding, to audio signals of a front-left channel and a front-right channel, on the basis of head transfer functions, sound characteristics that allow a listener to feel localized virtual sound sources in the listener's audibility at preset front-left and front-right positions; and a sound emitting direction control unit which distributes each of the left and right audio signals generated by the sound source localization adding unit to one or plural speaker units of the array speaker, and controls timing with which the speaker units output the audio signals so that a left sound emitted from the array speaker forms the same sound wavefront as would be formed by a sound emitted from one of two virtual point sound sources located behind the array speaker and that a right sound emitted from the array speaker forms the same sound wavefront as would be formed by a sound emitted from the other of the two virtual point sound sources.

When a listener listens to sound beams that are emitted from an array speaker and directed to a listening position by being reflected by walls in an environment in which the listening position is close to the array speaker or the wall reflection conditions are bad, the listener may not be able to feel a sound field (sound expanse). In contrast, in the array speaker apparatus having the above configuration, left and right audio signals that have been given, on the basis of head transfer functions, characteristics that allow a listener to feel localized virtual sound sources at preset positions are output so that the same sound wavefronts as would be formed by sounds emitted from virtual point sound sources set behind the array speaker are formed. This allows the listener to feel the same sound field (sound expanse) as in a case that localized virtual sound sources are generated by left and right sounds that are based on the head transfer functions and are emitted from two ideal point sound sources located behind the array speaker.

In the case of two-channel or three-channel audio signals, the front-left channel means the left channel (Lch) and the front-right channel means the right channel (Rch).

(2) Preferably, the sound source localization adding unit includes a crosstalk correcting unit which generates audio signals for canceling audio signals for opposite ears of the listener so that the listener can hear, only through the listener's left ear, the left sound emitted as if to be emitted from the one virtual point sound source and can hear, only through the listener's right ear, the right sound emitted as if to be emitted from the other virtual point sound source located behind the array speaker.

In the array speaker apparatus having this configuration, crosstalk cancellation is performed on the left and right audio signals that are given the characteristics that allow the listener to feel localized virtual sound sources at the preset front-left and front-right positions. This allows the listener to feel localized virtual sound sources of the front-left and front-right channels in a more enhanced manner.

(3) Preferably, the array speaker apparatus further comprising a calculating unit which calculates a distance from the array speaker to a listening position of the listener, and the sound emitting direction control unit changes the positions of the two virtual point sound sources according to the calculated distance so that a horizontal angle formed by the listening position and each of the two virtual point sound sources is kept approximately constant.

In conventional systems that generate localized virtual sound sources on the basis of head transfer functions, in many cases a listener cannot recognize ideal localization because two separate speakers and the listener are arranged so as to have an arbitrary positional relationship and hence the conditions are much different than when the system was designed (the head transfer functions were determined). In contrast, in the array speaker apparatus having the above configuration, to keep approximately constant the horizontal angle formed by the listening position and each of the two virtual point sound sources, a distance from the array speaker to the listening position is calculated and the positions of the two virtual point sound sources are changed according to the calculated distance. As a result, the horizontal angle which is an important design item can be kept constant and the listener is allowed to feel a sound field with ideal localization.

(4) Preferably, the sound emitting direction control unit distributes an audio signal of a center channel to plural speaker units of the array speaker and controls timing with which the speaker units output the audio signal so that a sound emitted from the array speaker forms the same sound wavefront as would be formed by a sound emitted from a virtual point sound source located behind the array speaker.

In the array speaker apparatus having this configuration, an audio signal of the center channels is output so as to form the same sound wavefront as would be formed by a sound emitted from a virtual point sound source located behind the array speaker. As a result, the audio signal of the center channels allows the listener to feel a distance, that is, a depth.

(5) Preferably, the sound source localization adding unit generates left and right audio signals by performing localization processing for adding, to audio signals of a rear-left channel and a rear-right channel, on the basis of head transfer functions, sound characteristics that allow the listener to feel localized virtual sound sources in the listener's audibility at preset rear-left and rear-right positions.

In the array speaker apparatus having this configuration, localization of the rear-left channel and the rear-right channel is attained on the basis of the head transfer functions. This allows the listener to feel a surround sense even in the case where there are no walls for reflecting sound beams.

(6) Preferably, the array speaker apparatus further comprises a beam control unit which distributes audio signals of a rear-left channel and a rear-right channel to all or part of the speaker units of the array speaker, and controls timing with which the audio signals are output from the speaker units so that sound beams are emitted from the array speaker.

In the array speaker apparatus having this configuration, sound beams of the rear-left channel and the rear-right channel are emitted. This allows the listener to feel a surround sense in a case that sound beams of audio signals of the rear-left channel and the rear-right channel can easily be reflected to the listening position whereas it is difficult to reflect sound beams of audio signals of the front-left channel and the front-right channel to the listening position, as in the case where the array speaker apparatus is installed at a corner of a room.

(7) Another array speaker apparatus, comprising:

an array speaker in which plural speaker units are arranged in a single body;

a sound source localization adding unit which generates left and right audio signals by performing localization processing for adding, to audio signals of a rear-left channel and a rear-right channel, on the basis of head transfer functions, sound characteristics that allow a listener to feel localized virtual sound sources in the listener's audibility at preset rear-left and rear-right positions;

a sound emitting direction control unit which distributes each of the left and right audio signals generated by the sound source localization adding unit to one or plural speaker units of the array speaker, controls timing with which the speaker units output the audio signals so that a left sound emitted from the array speaker forms the same sound wavefront as would be formed by a sound emitted from one of two virtual point sound sources located behind the array speaker and that a right sound emitted from the array speaker forms the same sound wavefront as would be formed by a sound emitted from the other of the two virtual point sound sources, distributes an audio signal of a center channel to plural speaker units of the array speaker, and controls timing with which the speaker units output the audio signal so that a sound emitted from the array speaker forms the same sound wavefront as would be formed by a sound emitted from a virtual point sound source located behind the array speaker; and a beam control unit which distributes audio signals of a front-left channel and a front-right channel to all or part of the speaker units of the array speaker, and controls timing with which the audio signals are output from the speaker units so that sound beams are emitted from the array speaker.

In the array speaker apparatus having this configuration, audio signals of the front-left channel and the front-right channel are converted into sound beams, audio signals of the rear-left channel and the rear-right channel are subjected to localization processing and resulting sounds are emitted as if to be emitted from virtual point sound sources, and a sound of the center channel is emitted as if to be emitted from a virtual point sound source. This allows the listener to feel a surround sense even in, for example, a case that the array speaker unit is installed in a room in which no wall exists behind the listening position.

(8) A further array speaker apparatus, comprising:

an array speaker in which plural speaker units are arranged in a single body;

a control unit which sets a sound emission method of multichannel surround audio signals;

a sound source localization adding unit which generates audio signals of one or more channels that conform to the setting of the control unit by performing localization processing for adding, to audio signals of the one or more channels, on the basis of head transfer functions, sound characteristics that allow a listener to feel localized virtual sound sources in the listener's audibility at desired localization positions of the one or more channels;

a sound emitting direction control unit which distributes each of the audio signals of the one or more channels excluding a center channel generated by the sound source localization adding unit to one or plural speaker units of the array speaker, controls timing with which the speaker units output the audio signals so that sounds emitted from the array speaker form the same sound wavefronts as would be formed by sounds emitted from two virtual point sound sources located behind the array speaker, distributes an audio signal of the center channel to plural speaker units of the array speaker, and controls timing with which the speaker units output the audio signal so that a sound emitted from the array speaker forms the same sound wavefront as would be formed by a sound emitted from a virtual point sound source located behind the array speaker; and a beam control unit which distributes an audio signal of a channel excluding the center channel that has not been subjected to the localization processing to all or part of the speaker units of the array speaker, and controls timing with which the audio signal is output from the speaker units so that a sound beam is emitted from the array speaker.

In the array speaker apparatus having this configuration, a sound of the center channel is emitted as if to be emitted from a virtual point sound source, audio signals of arbitrary channels are subjected to localization processing on the basis of head transfer functions, and audio signals of the remaining channels are converted into sound beams. This allows the listener to feel a surround sense irrespective of whether wall reflection can be utilized.

In the array speaker apparatus according to the invention, left and right audio signals that have been given, on the basis of head transfer functions, characteristics that allow a listener to feel localized virtual sound sources at preset positions are output so that the same sound wavefronts as would be formed by sounds emitted from virtual point sound sources set behind the array speaker are formed. This allows the listener to feel the same sound field (sound expanse) as in a case that localized virtual sound sources are generated by left and right sounds that are based on the head transfer functions and are emitted from two ideal point sound sources located behind the array speaker.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1A:
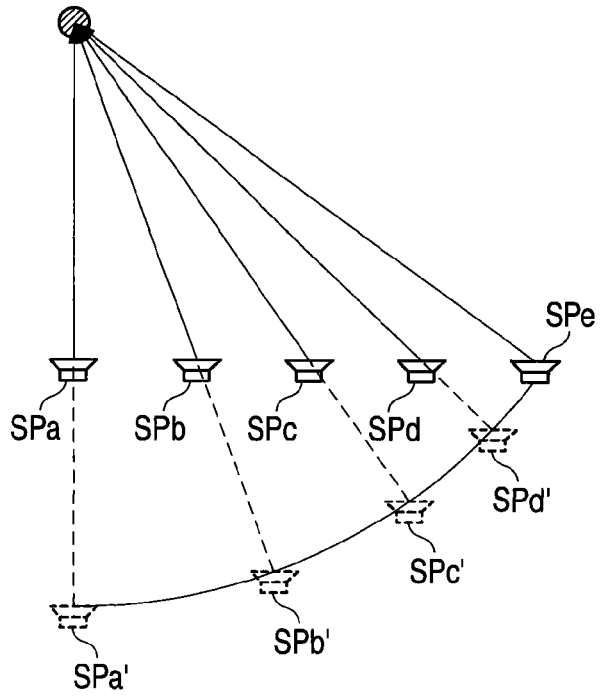
FIG. 1 shows the principle of an array speaker and a surround sound field as generated by an array speaker apparatus.
Figure 1B:
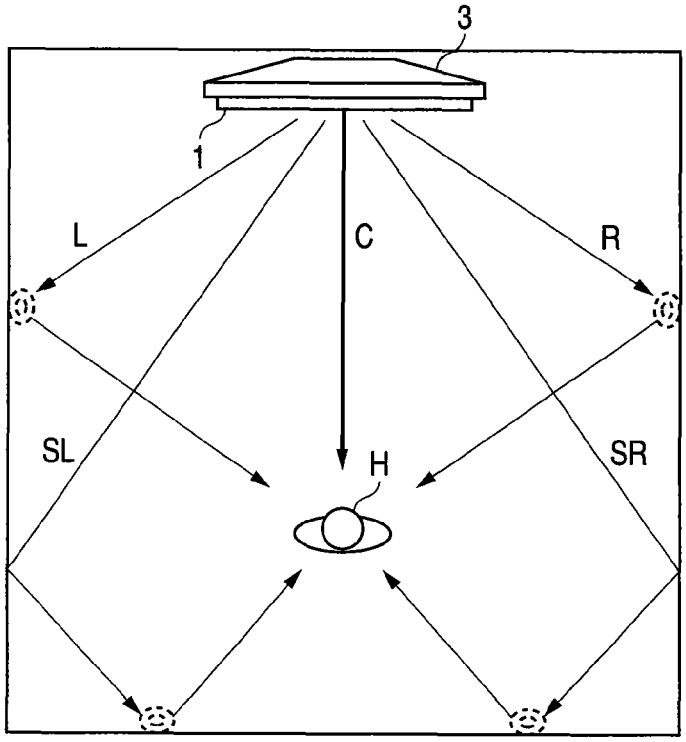
Figure 2:
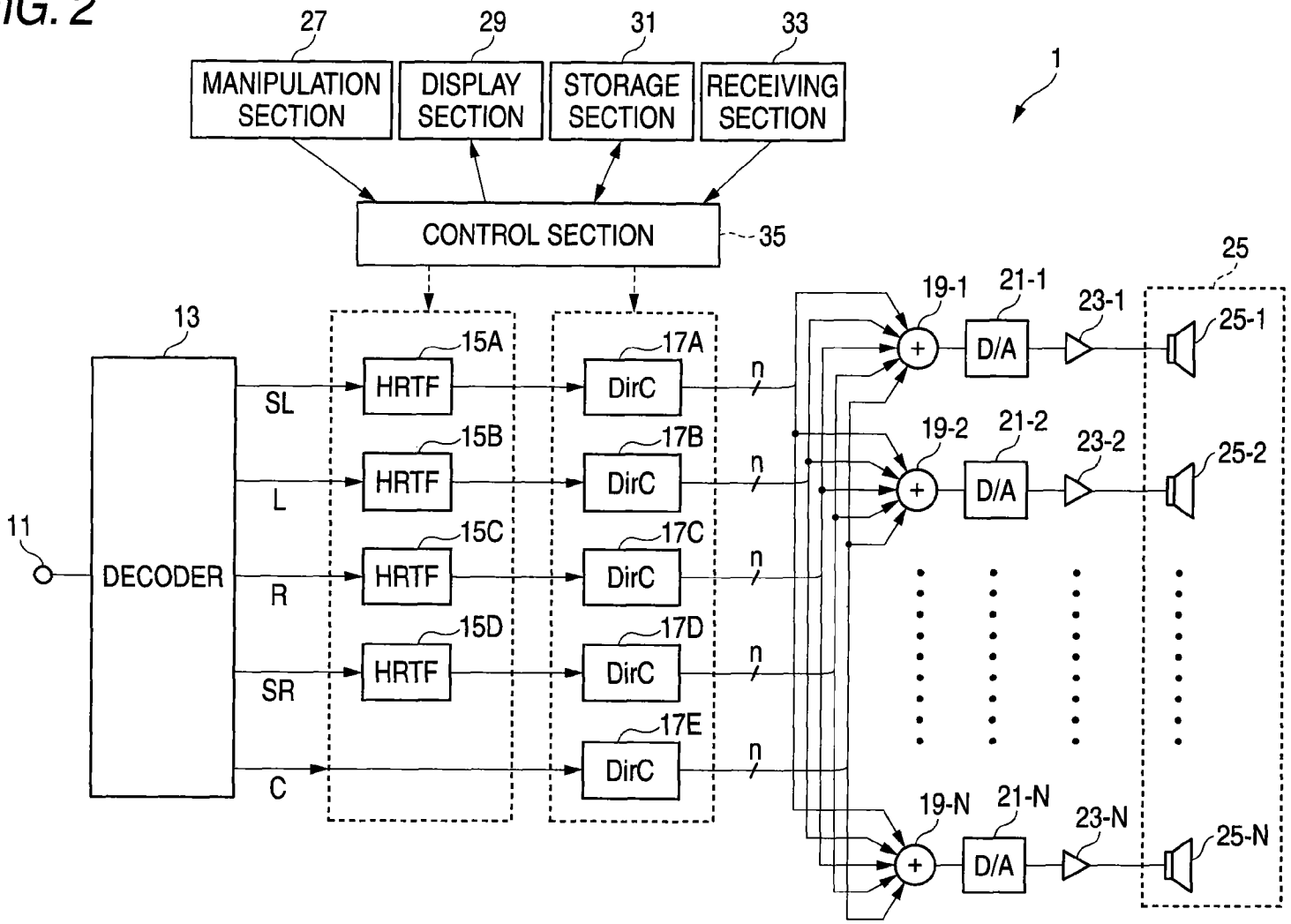
FIG. 2 is a block diagram showing a general configuration of an array speaker apparatus according to an embodiment of the present invention.

FIG. 2 is a block diagram showing a general configuration of an array speaker apparatus according to an embodiment of the present invention. The following description will be directed to a 5.1ch surround system as an exemplary array speaker apparatus. In the following description, in the 5.1ch surround system, the front-left channel is denoted by "Lch," the front-right channel is denoted by "Rch," the center channel is denoted by "Cch," the rear-left channel is denoted by "SLch" (SL stands for surround left), the rear-right channel is denoted by "SRch" (SR stands for surround right), and the subwoofer channel is denoted by "LFEch" (LFE stands for low frequency effects). In the 5.1ch surround system, an LFEch audio signal has almost no directivity and is output directly to a user from the array speaker apparatus. Therefore, how to process an LFEch audio signal will not be described in the following.

First, a description will be made of a general operation of the array speaker apparatus 1. The array speaker apparatus 1 can output audio signals in the form of sound beams or virtually localize sound sources on the basis of head transfer functions according to a user's setting. The array speaker apparatus 1 can output, in the form of a sound beam, an audio signal of a certain channel and virtually localize a sound source using a sound of another channel. These features make it possible to provide multichannel surround sounds irrespective of the room shape and the installation place.

Next, a description will be made of a specific configuration of the array speaker apparatus 1. As shown in FIG. 2, the array speaker apparatus 1 includes an input terminal 11, a decoder 13, head transfer function processing sections (hereinafter abbreviated as HRTFs) 15A-15D, direction control sections (abbreviated as DirC in FIG. 2) 17A-17E, adders 19-1 to 19-N, D/A converters 21-1 to 21-N, power amplifiers 23-1 to 23-N, speaker units 25-1 to 25-N which constitute an array speaker 25, a manipulation section 27, a display section 29, a storage section 31, a receiving section 33, and a control section 35.

The input terminal 11 is connected to an external audio apparatus (not shown), and a (digital) audio signal that is output from the external audio apparatus is input through the input terminal 11.

The decoder 13 decodes the (digital) audio signal that is input through the input terminal 11, and outputs an SLch audio signal, an Lch audio signal, an Rch audio signal, an SRch audio signal, and a Cch audio signal to the HRTFs 15A, 15B, 15C, and 15D and the direction control section 17E, respectively.

The HRTFs 15A-15D add, on the basis of head transfer functions, according to settings of the control section 35, audibility characteristics that allow a listener to feel localization in directions (e.g., directions according to ITU-R BS.775-1) that are suitable for audio signals of one or more channels, to input signals.

The direction control sections 17A-17E generate signals that are delayed by necessary times from the audio signals of the respective channels and distribute each of the generated signals to one or plural ones of the speaker units 25-1 to 25-N. The delays added by the direction control sections 17A-17E make it possible to convert the signal of each channel into a sound beam or to form a sound wavefront coming from a virtual point sound source that is located behind the array speaker 25.

The adders 19-1 to 19-N add together the audio signals that are output from the direction control sections 17A-17E.

The D/A converters 21-1 to 21-N convert the digital audio signals that are output from the adders 19-1 to 19-N into analog audio signals, respectively.

The power amplifiers 23-1 to 23-N amplify the analog audio signals that are output from the D/A converters 21-1 to 21-N, respectively.

The speaker units 25-1 to 25-N convert amplified audio signals that are output from the power amplifiers 23-1 to 23-N into sounds and emit them, respectively.

The manipulation section 27 receives a speaker setting manipulation or the like on the array speaker apparatus 1 and outputs a corresponding signal to the control section 35.

The display section 29 displays information of which a user is to be informed, on the basis of a control signal that is output from the control section 35.

Speaker setting patterns etc. are stored in the storage section 31, and data is read from the storage section 31 by the control section 35 in response to a manipulation received by the manipulation section 27.

The receiving section 33 receives a signal that is output from a remote controller 5.

The control section 35 controls the individual sections and units of the array speaker apparatus 1.

Having the above configuration, the array speaker apparatus 1 localizes a virtual sound source corresponding to an audio signal of each channel on the basis of a head transfer function and also localizes a sound image by generating a sound beam and causing it to be reflected by a wall.

Figure 3:
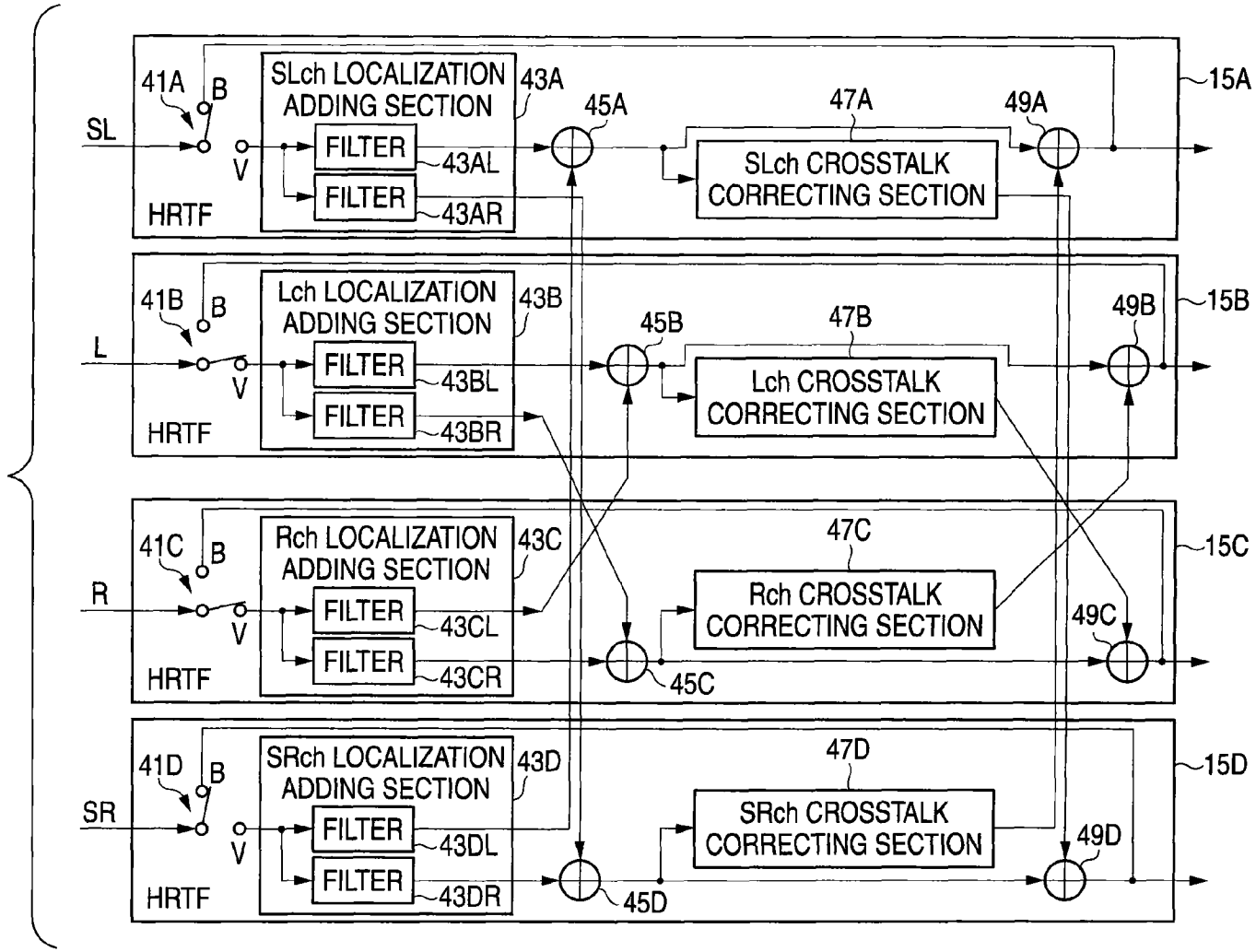
FIG. 3 is a block diagram showing an exemplary configuration of HRTFs.

FIG. 3 is a block diagram showing an exemplary configuration of the HRTFs 15A-15D. The HRTFs 15A-15D include switches 41A-41D, localization adding sections 43A-43D, adders 45A-45D, crosstalk correcting sections 47A-47D, and adders 49A-49D, respectively.

In the HRTF 15A, the switch 41A is a switch for bypassing an SLch audio signal and is switched according to a control signal supplied from the control section 35. More specifically, if the switch 41A is switched to a terminal V side, an SLch audio signal is supplied to the localization adding section 43A and is given virtual localization on the basis of a head transfer function. On the other hand, if the switch 41A is switched to a terminal B side, an SLch audio signal is supplied to the direction control section 17A bypassing the localization adding section 43A.

The localization adding section 43A has FIR filters 43AL and 43AR. Filter coefficients that are based on a transfer function from a sound image to be localized at a rear-left position of a listener to his or her left ear are set in the FIR filter 43AL, and filter coefficients that are based on a transfer function from the same sound image to the right ear of the listener are set in the FIR filter 43AR. The SLch audio signal is given virtual localization by presenting outputs of the FIR filters 43AL and 43AR to the left ear and the right ear of the listener, respectively.

The adder 45A adds together the output audio signal of the FIR filter 43AL and an output audio signal of an FIR filter 43DL of the localization adding section 43D.

Filter coefficients corresponding to the inverse of a head transfer function from an output position of the output of the HRTF 15A to the right ear of the listener are set in the crosstalk correcting section 47A. A signal generated by the crosstalk correcting section 47A is superimposed on a signal to be presented to the right ear from the HRTF 15D, whereby crosstalk, to the right ear, of the output of the HRTF 15A which is desired to be presented to only the left ear is canceled.

The adder 49A adds together an output audio signal of the adder 45A and an output audio signal of the crosstalk correcting section 47D of the HRTF 15D and outputs a resulting audio signal to the direction control section 17A. Crosstalk of an output of the HRTF 15D to the left ear of the listener is canceled by this processing.

The HRTFs 15A and 15D operate in pair, and the HRTF 15A generates both of SLch and SRch signals to be presented to the left ear of the listener and the HRTF 15D generates both of SLch and SRch signals to be presented to the right ear of the listener.

The HRTFs 15B and 15C perform, on Lch and Rch audio signals, processing that is similar to the processing performed by the HRTFs 15A and 15D on SLch and SRch audio signals.

FIG. 3 shows the exemplary configuration of the HRTFs 15A-15D that give audibility characteristics that allow a listener to feel localization in particular directions by performing frequency characteristic addition processing, processing for adding phase differences and sound pressure differences between the two ears, and crosstalk cancellation processing. However, the invention is not limited to such a case. The HRTFs 15A-15D may give audibility characteristics that allow a listener to feel localization in particular directions only by frequency characteristic addition processing or by frequency characteristic addition processing and processing for adding phase differences and sound pressure differences between the two ears.

[Measure against Variation in Listening Distance]

Figure 4:
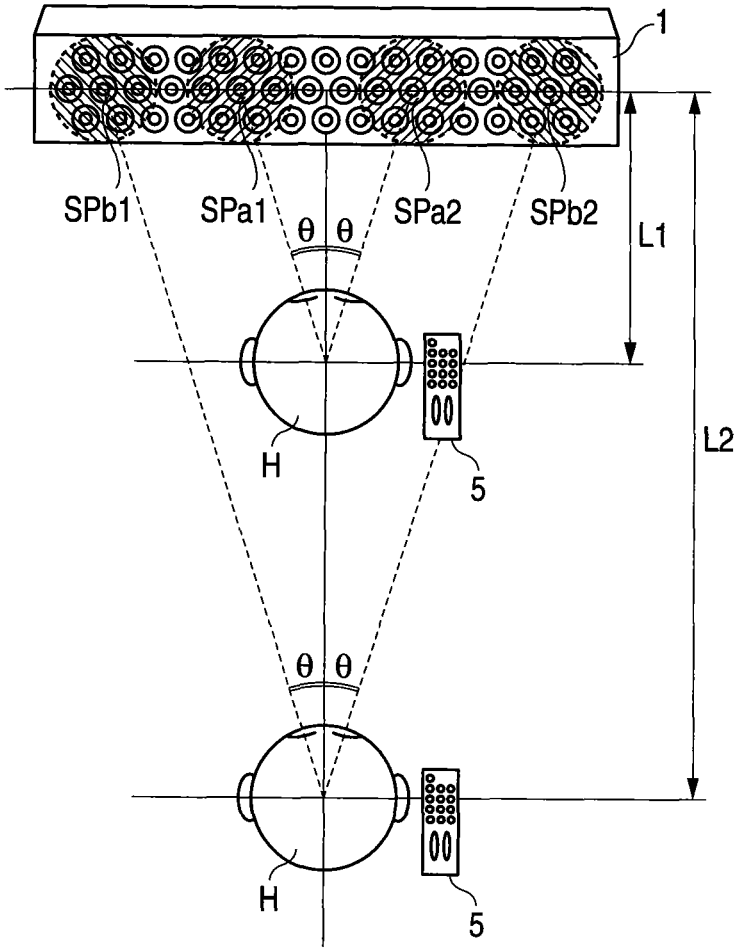
FIG. 4 illustrates a measure against a variation in listening distance.

FIG. 4 illustrates a measure against a variation in listening distance. In the array speaker apparatus 1, when virtual sound sources are localized by the direction control sections 17A-17E, the positions of the speaker units that emit sounds are changed according to the listening position so that the angle (hereinafter referred to as a horizontal angle) θ formed by the straight line connecting the listening position and the speaker units that emit sounds and the straight line connecting the center of the array speaker apparatus 1 and the listening position is kept at a constant value.

For example, as shown in FIG. 4, when the distance between the array speaker apparatus 1 and the listening position is L1, sounds that localize virtual sound sources are emitted from speaker unit groups SPa1 and SPa2 that are close to the center of the array speaker apparatus 1. In this case, the horizontal angle formed by each of the speaker unit groups SPa1 and SPa2 and the listening position of a listener H is equal to θ.

When the distance between the array speaker apparatus 1 and the listening position is L2, sounds that localize virtual sound sources are emitted from outside speaker unit groups SPb1 and SPb2 of the array speaker apparatus 1. Also in this case, the horizontal angle formed by each of the speaker unit groups SPb1 and SPb2 and the listening position of the listener H is equal to θ.

Although in the example of FIG. 4 each of the speaker unit groups SPa1 etc. consists of seven speaker units, the invention is not limited to such a case. Each speaker unit group may consists of more than or less than seven speaker units or may have only a single speaker unit.

In conventional systems which attain localization on the basis of head transfer functions, in many cases a listener cannot recognize ideal localization because two separate speakers and a listening position are arranged so as to have an arbitrary positional relationship and hence the conditions are much different than when the system was designed (the head transfer functions were determined). In contrast, the array speaker apparatus 1 allows a listener to feel a sound field that is produced by ideal localization because the horizontal angle of two sound sources can always be kept constant.

One method for measuring the distance between the array speaker apparatus 1 and the listening position is such that a microphone is incorporated in the remote controller 5, a test sound is emitted from the array speaker apparatus 1, and a time taken for the sound to reach the remote controller 5 is measured.

[Generation of Point Sound Source/Virtual Sound Sources for Lch and Rch]

A sound wavefront of sounds emitted from the array speaker 25 can be made the same as that of a sound emitted from a virtual point sound source that is disposed behind the sound emitting surface of the array speaker 25 can be formed by controlling the timing with which speaker units emit sounds.

Figure 5A:
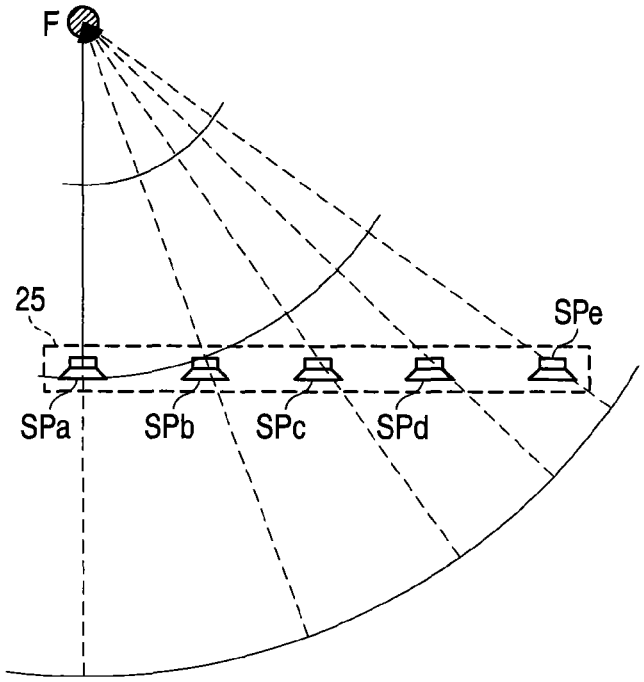
FIG. 5 is a schematic diagram illustrating a method for generating a point sound source and a diagram showing how Lch and Rch virtual sound sources are generated by sounds emitted as if to be emitted from two point sound sources.

FIG. 5 is a schematic diagram illustrating a method for generating a point sound source and a diagram showing how Lch and Rch virtual sound sources are generated by sounds emitted as if to be emitted from two point sound sources.

Figure 5B:
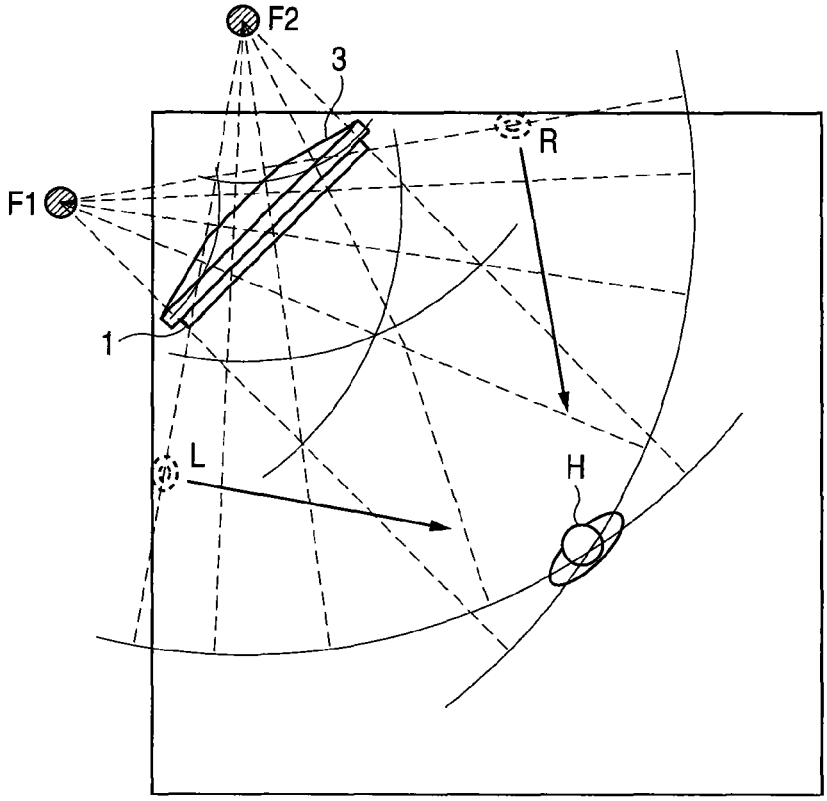

As shown in FIG. 5B, an imaginary sound emitted from a point sound source F travels through the space in the form of a spherical wavefront. The same wavefront as would be formed by a sound emitted from the point sound source F can be formed by performing a control so that signals applied to speaker units SPa-SPe (arranged in line or in a plane) of the array speaker 25 are given such delays that the speaker units SPa-SPe emit sounds at time points when a sound emitted from the point sound source F would reach the respective speaker units SPa-SPe. In the array speaker apparatus 1, the direction control sections 17A-17E add proper delays under the control of the control section 35.

Localizing a virtual point sound source behind the array speaker apparatus 1 in the above manner allows a listener to feel a sufficient distance from the sound source even in the case where the listening position is close to the array speaker apparatus 1. Since the position of a virtual point sound source can be set arbitrarily by adding proper delays, a most appropriate sound emission position of a sound source that is given a head transfer function can be selected. Furthermore, as shown in FIG. 4, the sound source position can be changed in accordance with a variation of the listening position.

In the array speaker apparatus 1, signals that have been processed for localization in the HRTFs 15A-15D are output as if resulting sounds are emitted from virtual point sound sources. As shown in FIG. 5B, an output signal of the HRTF 15B is output as if a resulting sound is emitted from a virtual point sound source F1 and an output signal of the HRTF 15C is output as if a resulting sound is emitted from a virtual point sound source F2. As a result, Lch and Rch sounds are virtually localized at a front-left position and a front-right position of a listener H, respectively.

In the array speaker apparatus 1, as shown in FIG. 4, a sound generated by performing localization processing on an audio signal on the basis of a head transfer function may be used for a purpose other than forming a wavefront originating from a virtual point sound source; that is, it is possible that only one of the speaker units of the array speaker 25 emits a sound or plural ones of the speaker units emit sounds simultaneously.

[Generation of Point Sound Source for Cch]

In the array speaker apparatus 1, a sound wavefront of a sound emitted as if to be emitted from a point sound source that is set behind the sound emitting surface of the array speaker 25 can also be formed by synthesis for the center channel like sound wavefronts for Lch and Rch.

Figure 6:
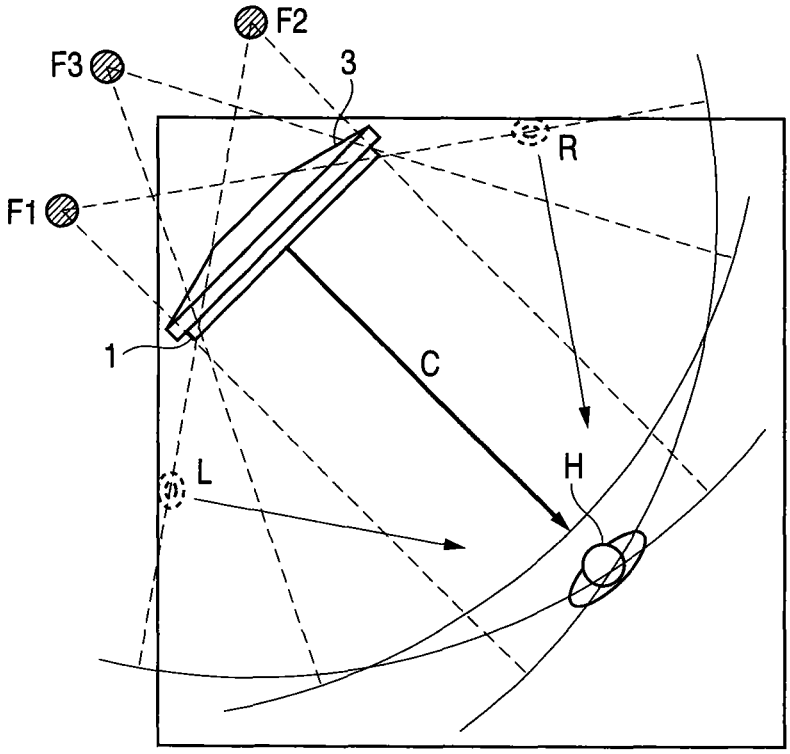
FIG. 6 shows virtual sound sources of Lch and Rch generated by two point sound sources and a sound of Cch emitted from a point sound source.

FIG. 6 shows virtual sound sources of Lch and Rch generated by two point sound sources and a sound of Cch emitted from a point sound source. As shown in FIG. 6, sounds of Lch and Rch that have been subjected to localization processing on the basis of head transfer functions are emitted as if to be emitted from virtual point sound sources F1 and F2 and a sound of Cch is emitted as if to be emitted from a virtual point sound source F3. The sounds of Lch and Rch are virtually localized at a front-left position L and a front-right position R of a listener H, respectively, to allow him or her to feel a sound field expanse and the sound of Cch is localized at a center position with a natural depth. A good sound field can thus be provided to the listener H.

[Generation of Virtual Sound Sources for Lch, Rch, SLch, and SRch and Point Sound Source for Cch]

Figure 7A:
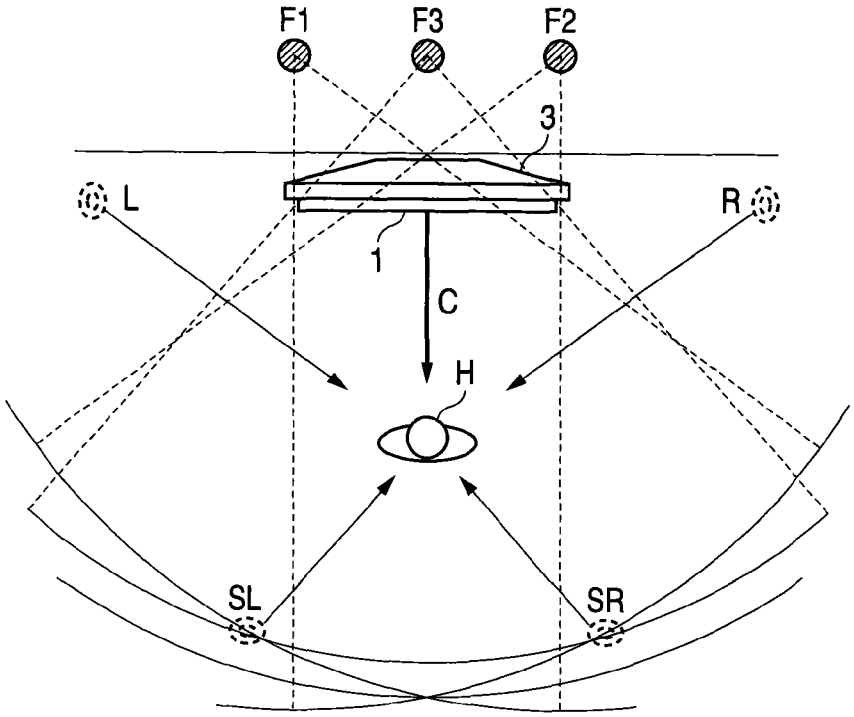
FIG. 7 shows two sound emission methods of the array speaker apparatus.

FIG. 7 shows two sound emission methods of the array speaker apparatus 1. In the array speaker apparatus 1, as shown in FIG. 7A, it is possible to synthesize, for all channels excluding Cch (i.e., Lch, Rch, SLch, and SRch) of multichannel surround sounds, sound wavefronts of sounds that are emitted as if to be emitted from point sound sources by performing virtual localization on the basis of head transfer functions and to synthesize, only for Cch, a sound wavefront of a sound that is emitted as if to be emitted from a point sound source.

If this mode is selected by a listener H's manipulating the manipulation section 27, the control section 35 outputs control signals to the HRTFs 15A-15D and thereby switches the switches 41A-41D to the terminal V side. Furthermore, the control section 35 outputs control signals to the direction control sections 17A-17E. Based on these control signals, the direction control sections 17A and 17B perform controls so that a sound wavefront of a sound that is emitted as if to be emitted from a point sound source F1 located at a rear-left position of the array speaker apparatus 1 is synthesized. The direction control sections 17C and 17D perform controls so that a sound wavefront of a sound that is emitted as if to be emitted from a point sound source F2 located at a rear-right position of the array speaker apparatus 1 is synthesized. The direction control section 17E performs a control so that a sound wavefront of a sound that is emitted as if to be emitted from a point sound source F3 located at a rear-center position of the array speaker apparatus 1 is synthesized.

This mode is effective when the array speaker apparatus 1 is installed at a place with no walls.

[Generation of Sound Beams for SLch and SRch and Generation of Virtual Sound Sources for Lch and Rch]

Figure 7B:
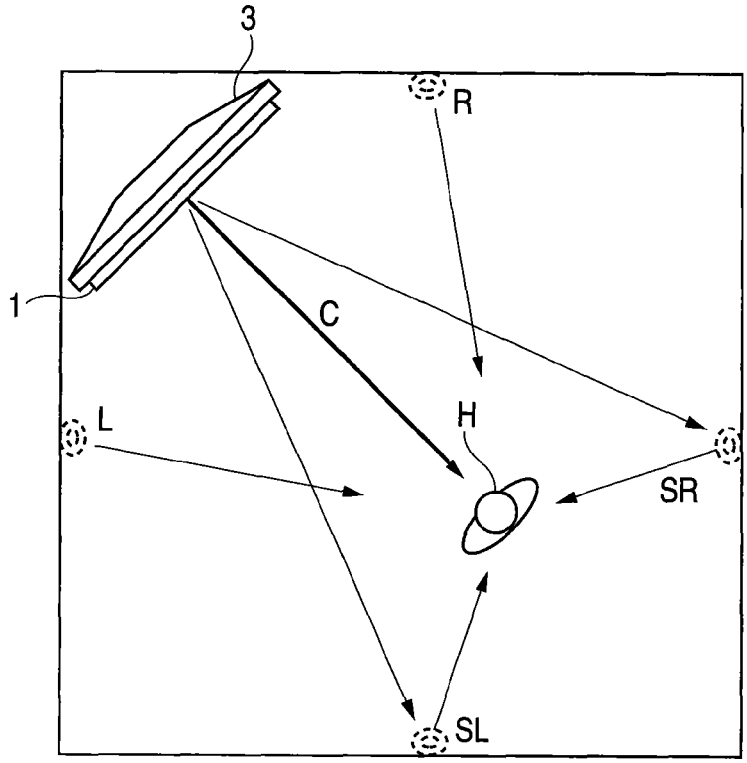

In the array speaker apparatus 1, as shown in FIG. 7B, it is possible to synthesize, for Lch and Rch, sound wavefronts of sounds that are emitted as if to be emitted from point sound sources by performing virtual localization and to generate sound beams and cause them to be reflected by walls for SLch and SRch.

If this mode is selected by a listener H's manipulating the manipulation section 27, the control section 35 outputs control signals to the HRTFs 15A-15D and thereby switches the switches 41A and 41D to the terminal B side and switches the switches 41B and 41C to the terminal V side. Furthermore, the control section 35 outputs control signals to the direction control sections 17A-17E. Based on these control signals, the direction control sections 17A and 17D perform controls so that sound beams are emitted toward the left side and the right side of the listener H, respectively. The direction control sections 17B and 17C perform controls so that sound wavefronts of sounds that are emitted as if to be emitted from point sound sources (not shown) located at a rear-left position and a rear-right position of the array speaker apparatus 1 are synthesized, respectively. The direction control section 17E performs a control so that a sound wavefront of a sound that is emitted as if to be emitted from a point sound source (not shown) located at a rear-center position of the array speaker apparatus 1 is synthesized.

This mode is effective when the array speaker apparatus 1 is installed at a corner of a room.

[Generation of Sound Beams for Lch and Rch and Generation of Virtual Sound Sources for SLch and SRch]

Figure 8A:
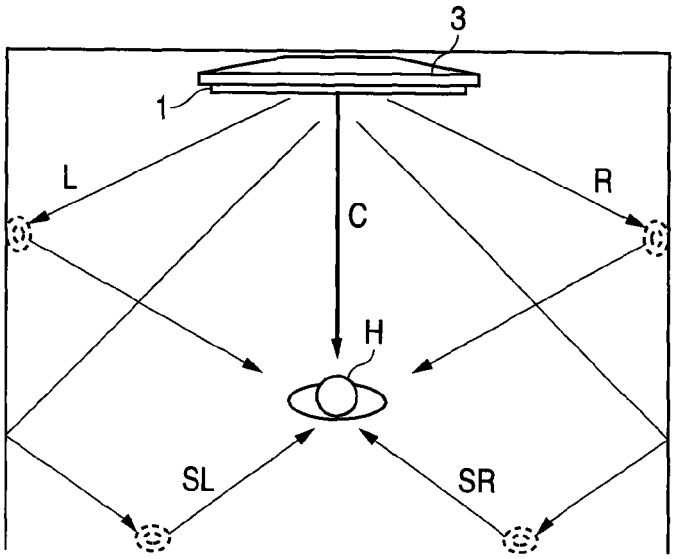
FIG. 8 shows three sound emission methods of the array speaker apparatus.

FIG. 8 shows three sound emission methods of the array speaker apparatus 1. In the array speaker apparatus 1, as shown in FIG. 8A, it is possible to synthesize, for SLch and SRch, sound wavefronts of sounds that are emitted as if to be emitted from point sound sources by performing virtual localization and to generate sound beams and cause them to be reflected by walls for Lch and Rch.

If this mode is selected by a listener H's manipulating the manipulation section 27, the control section 35 outputs control signals to the HRTFs 15A-15D and thereby switches the switches 41A and 41D to the terminal V side and switches the switches 41B and 41C to the terminal B side. Furthermore, the control section 35 outputs control signals to the direction control sections 17A-17E. Based on these control signals, the direction control sections 17A and 17D perform controls so that sound wavefronts of sounds that are emitted as if to be emitted from point sound sources located at a rear-left position and a rear-right position of the array speaker apparatus 1 are synthesized, respectively. The direction control sections 17B and 17C perform controls so that sound beams are emitted toward the left side and the right side of the listener H, respectively. The direction control section 17E performs a control so that a sound wavefront of a sound that is emitted as if to be emitted from a point sound source located at a rear-center position of the array speaker apparatus 1 is synthesized.

This mode is effective when no wall exists behind a listening position or rear sound beam paths cannot be secured.

[Other, Arbitrary Combinations of Sound Beams and Virtual Sound Sources]

Figure 8B:
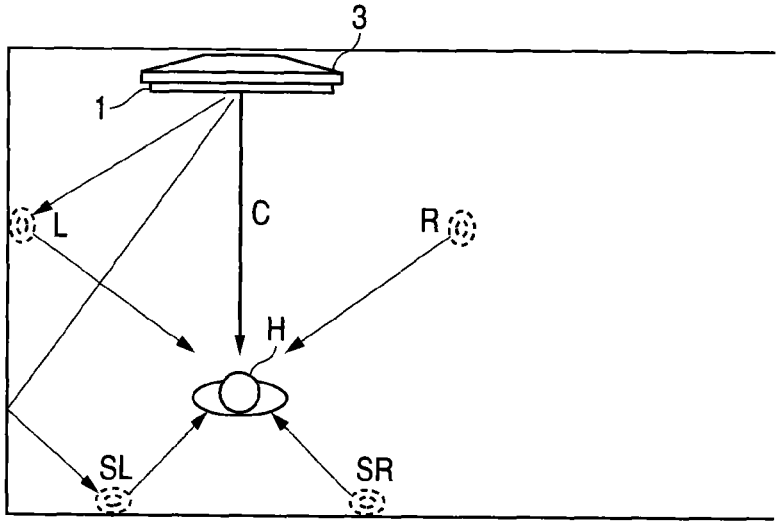

FIG. 8B shows a setting method that is effective when no wall exists on the right of a listener. In the array speaker apparatus 1, sound wavefronts of sounds that are emitted as if to be emitted from point sound sources by performing virtual localization are synthesized for Rch and SRch and sound beams are generated and caused to be reflected by walls for Lch and SLch.

Figure 8C:
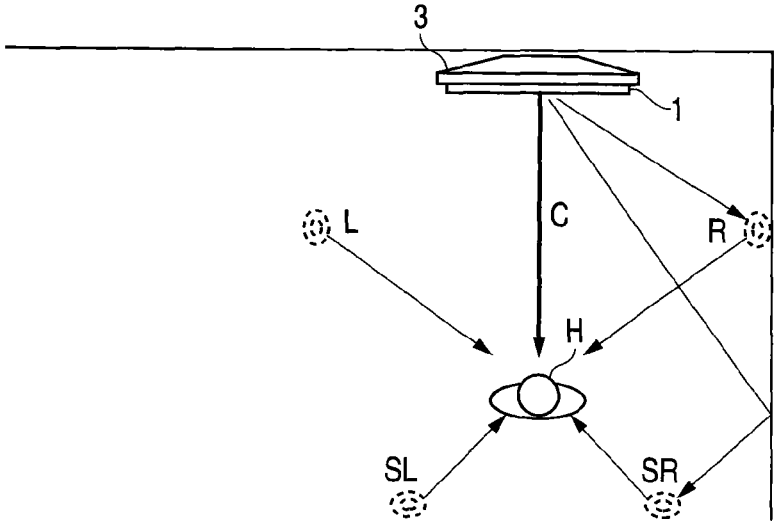

FIG. 8C shows a setting method that is effective when only one wall can be utilized. In the array speaker apparatus 1, sound wavefronts of sounds that are emitted as if to be emitted from point sound sources by performing virtual localization are synthesized for Lch, SLch, and SRch and a sound beam is generated and caused to be reflected by a wall for Rch.

As described above, the array speaker apparatus according to the invention can generate a virtual sound source by synthesizing a sound wavefront of a sound that is emitted as if to be emitted from a point sound source by performing virtual localization processing on an audio signal on the basis of a head transfer function or convert an audio signal into a sound beam for each channel. As a result, surround sounds can be provided to a listener irrespective of the installation environment of the array speaker apparatus.

[NEW]

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2007-061574 filed on Mar. 12, 2007, the contents of which are incorporated herein for reference.

What is claimed is:

1. An array speaker apparatus comprising:

an array speaker having plural speaker units arranged in a single body;

a sound source localization adding unit which generates left and right audio signals by performing localization processing for adding, to audio signals of a front-left channel and a front-right channel, on the basis of head transfer functions, sound characteristics that allow a listener to feel localized virtual sound sources in the listener's audibility at preset front-left and front-right positions;

a sound emitting direction control unit which distributes each of the left and right audio signals generated by the sound source localization adding unit to at least one speaker unit of the array speaker, and controls timing with which the speaker units output the audio signals so that a left sound emitted from the array speaker forms the same sound wavefront as would be formed by a sound emitted from one of two virtual point sound sources located behind the array speaker and that a right sound emitted from the array speaker forms the same sound wavefront as would be formed by a sound emitted from the other of the two virtual point sound sources; and a calculating unit which calculates a distance from the array speaker to a listening position of the listener, wherein the sound emitting direction control unit changes the positions of the plural speaker units from which the audio signals are output, according to the calculated distance so that a horizontal angle formed by the listening position and each of the plural speaker units is kept constant.

2. The array speaker apparatus according to claim 1, wherein the sound source localization adding unit includes a crosstalk correcting unit which generates audio signals for canceling audio signals for opposite ears of the listener so that the listener can hear, only through the listener's left ear, the left sound emitted as if to be emitted from the one virtual point sound source and can hear, only through the listener's right ear, the right sound emitted as if to be emitted from the other virtual point sound source located behind the array speaker.

3. The array speaker apparatus according to claim 1, wherein the sound emitting direction control unit distributes an audio signal of a center channel to all or part of the plural speaker units of the array speaker and controls timing with which the speaker units output the audio signal so that a sound emitted from the array speaker forms the same sound wavefront as would be formed by a sound emitted from a virtual point sound source located behind the array speaker.

4. The array speaker apparatus according to claim 1, wherein the sound source localization adding unit generates left and right audio signals by performing localization processing for adding, to audio signals of a rear-left channel and a rear-right channel, on the basis of head transfer functions, sound characteristics that allow the listener to feel localized virtual sound sources in the listener's audibility at preset rear-left and rear-right positions.

5. The array speaker apparatus according to claim 1, further comprising a beam control unit which distributes audio signals of a rear-left channel and a rear-right channel to all or part of the plural speaker units of the array speaker, and controls timing with which the audio signals are output from the speaker units so that sound beams are emitted from the array speaker.

6. An array speaker apparatus comprising:

an array speaker having plural speaker units arranged in a single body;

a sound source localization adding unit which generates left and right audio signals by performing localization processing for adding, to audio signals of a rear-left channel and a rear-right channel, on the basis of head transfer functions, sound characteristics that allow a listener to feel localized virtual sound sources in the listener's audibility at preset rear-left and rear-right positions;

a sound emitting direction control unit which distributes each of the left and right audio signals generated by the sound source localization adding unit to at least one of the plural speaker units of the array speaker, controls timing with which the speaker units output the audio signals so that a left sound emitted from the array speaker forms the same sound wavefront as would be formed by a sound emitted from one of two virtual point sound sources located behind the array speaker and that a right sound emitted from the array speaker forms the same sound wavefront as would be formed by a sound emitted from the other of the two virtual point sound sources, distributes an audio signal of a center channel to all or part of the plural speaker units of the array speaker, and controls timing with which the speaker units output the audio signal so that a sound emitted from the array speaker forms the same sound wavefront as would be formed by a sound emitted from a virtual point sound source located behind the array speaker;

a beam control unit which distributes audio signals of a front-left channel and a front-right channel to all or part of the plural speaker units of the array speaker, and controls timing with which the audio signals are output from the speaker units so that sound beams are emitted from the array speaker; and a calculating unit which calculates a distance from the array speaker to a listening position of the listener, wherein the sound emitting direction control unit changes the positions of the plural speaker units from which the audio signals are output, according to the calculated distance so that a horizontal angle formed by the listening position and each of the plural speaker units is kept constant.

7. An array speaker apparatus comprising:

an array speaker having plural speaker units arranged in a single body;

a control unit which sets a sound emission method of multichannel surround audio signals;

a sound source localization adding unit which generates audio signals of one or more channels that conform to the setting of the control unit by performing localization processing for adding, to audio signals of the one or more channels, on the basis of head transfer functions, sound characteristics that allow a listener to feel localized virtual sound sources in the listener's audibility at desired localization positions of the one or more channels;

a sound emitting direction control unit which distributes each of the audio signals of the one or more channels, excluding a center channel generated by the sound source localization adding unit, to at least one of the plural speaker units of the array speaker, controls timing with which the speaker units output the audio signals so that sounds emitted from the array speaker form the same sound wavefronts as would be formed by sounds emitted from two virtual point sound sources located behind the array speaker, distributes an audio signal of the center channel to all or part of the plural speaker units of the array speaker, and controls timing with which the speaker units output the audio signal so that a sound emitted from the array speaker forms the same sound wavefront as would be formed by a sound emitted from a virtual point sound source located behind the array speaker;

a beam control unit which distributes an audio signal of a channel, excluding the center channel that has not been subjected to the localization processing, to all or part of the speaker units of the array speaker, and controls timing with which the audio signal is output from the speaker units so that a sound beam is emitted from the array speaker; and a calculating unit which calculates a distance from the array speaker to a listening position of the listener, wherein the sound emitting direction control unit changes the positions of the plural speaker units from which the audio signals are output, according to the calculated distance so that a horizontal angle formed by the listening position and each of the plural speaker units is kept constant.

* * * * *